United States Patent [19]

Iwanaga

[11] 4,208,233

[45] Jun. 17, 1980

[54] LITHOGRAPHIC AND ETCHING APPARATUS

[75] Inventor: Yoshiharu Iwanaga, Tokyo, Japan

[73] Assignee: Ricoh Company, Ltd., Tokyo, Japan

[21] Appl. No.: 929,418

[22] Filed: Jul. 31, 1978

[30] Foreign Application Priority Data

Aug. 1, 1977 [JP] Japan ..... 52-91451

[51] Int. Cl.[2] ..... C23F 1/08; C23F 1/02

[52] U.S. Cl. ..... 156/345; 15/102; 134/64 R; 156/905; 101/132.5; 101/141; 271/245; 271/270

[58] Field of Search ..... 101/130, 131.5, 132.5, 101/463, 450–452, 141, 465, 466; 156/905, 345; 15/77, 102; 134/64 R, 64 P, 122 R, 122 P; 271/202, 203, 270, 272, 275, 264, 245

[56] References Cited

U.S. PATENT DOCUMENTS

| | | | |
|---|---|---|---|
| 1,545,915 | 7/1925 | Maxson | 271/202 |
| 2,110,585 | 3/1938 | Barber | 271/202 |
| 2,231,274 | 2/1941 | Marcher | 101/132.5 |
| 2,260,464 | 10/1941 | Kropp | 101/132.5 |
| 2,407,443 | 9/1946 | Peterson | 101/132.5 |
| 2,749,120 | 6/1956 | Mallory | 271/212 |
| 3,170,391 | 2/1965 | Ritzerfeld | 101/132.5 |
| 3,930,925 | 1/1976 | Yamanaka | 156/345 |
| 3,987,722 | 10/1976 | Goodwin | 101/450 |
| 4,036,135 | 7/1977 | Raible | 101/463 |

*Primary Examiner*—Clyde I. Coughenour
*Attorney, Agent, or Firm*—David G. Alexander

[57] ABSTRACT

A feed unit (17) feeds a master sheet (14) from an etching unit (28) to a master drum (13), the distance from the etching unit (28) to the feed unit (17) being smaller than the length of the master sheet (14). The feed unit (17) includes a support member (48); (73) disposed above the etching unit (28) and a retractable stopper (41). A lifting member (48); (72) lifts the trailing edge portion of the master sheet (14) onto the support member (48); (73) after the leading edge portion of the master sheet (14) is abuttingly stopped by the stopper (41). The support member (48); (73) and lifting member (48); (72) may be integral and constituted by a conveyor belt (48). Alternatively, the support member (48); (73) may be constituted by a support plate (73) and the lifting member (48); (72) constituted by a rocker frame (72).

9 Claims, 10 Drawing Figures

LITHOGRAPHIC AND ETCHING APPARATUS

BACKGROUND OF THE INVENTION

The present invention relates to a lithographic apparatus such as an offset printing machine comprising a novel and unique master sheet feed device.

Such an apparatus generally comprises an etching unit for etching a master sheet and a master drum for windingly supporting the master sheet for printing.

A major problem which has remained heretofore unsolved in the prior art is to devise a convenient manner of feeding the master sheet from the etching unit to the drum. Since a clamp is provided on the master drum to clamp the leading edge portion of the master sheet, the timing of feeding the master sheet to the drum must be exact. An error in timing will result in the sheet not being fed into the clamp but being fed in an erroneous manner to jam between the master drum, transfer drum, etc.

The problem is compounded by the fact that the speed of the master sheet being fed through the etching unit is generally different from the surface speed of the master drum. It has been practiced in the prior art to provide a conveyor belt between the etching unit and the master drum to accomodate the speed difference. However, such a conveyor belt serves to increase the overall size of the apparatus to an unacceptable extent.

It is also known to temporarily synchronize the speeds of the etching unit drive means and the master drum. This expedient requires an electronic speed control means and/or a mechanical speed converter such as a transmission. Both of these devices are expensive and undesirably increase the overall cost and complexity of the apparatus. Even if such a device is provided it does not overcome the problem of feed timing.

SUMMARY OF THE INVENTION

In accordance with the present invention, a lithographic apparatus includes a master drum for holding a master sheet and etching means for etching the master sheet and having means for feeding the master sheet therethrough. Feed means are disposed between the etching means and the master drum for feeding the master sheet from the etching means into engagement with the master drum, a distance from the etching means to the feed means being smaller than a length of the master sheet. The feed means include retractable stop means against which a leading edge of the master sheet is stoppingly abutable, support means disposed above the etching means for supporting a trailing edge portion of the master sheet and lifting means for lifting the trailing edge portion of the master sheet onto the support means.

It is an object of the present invention to provide an improved lithographic apparatus comprising an etching unit and a master drum disposed in close proximity, and novel and unique feed means for feeding the master sheet to the drum from the etching unit.

It is another object of the present invention to provide a lithographic apparatus comprising an etching unit and a master drum which operate at different speeds, and a feed means disposed between the etching unit and the master drum which accomodates the speed difference.

It is another object of the present invention to provide a lithographic apparatus comprising unique feed means which feed a master sheet from an etching unit to a master drum at perfect timing.

It is another object of the present invention to provide a generally improved lithographic apparatus.

Other objects, together with the foregoing, are attained in the embodiments described in the following description and illustrated in the accompanying drawing.

DESCRIPTION OF THE PREFERRED EMBODIMENTS

While the lithographic apparatus of the present invention is susceptible of numerous physical embodiments, depending upon the environment and requirements of use, substantial numbers of the herein shown and described embodiments have been made, tested and used, and all have performed in an eminently satisfactory manner.

Figure 1:
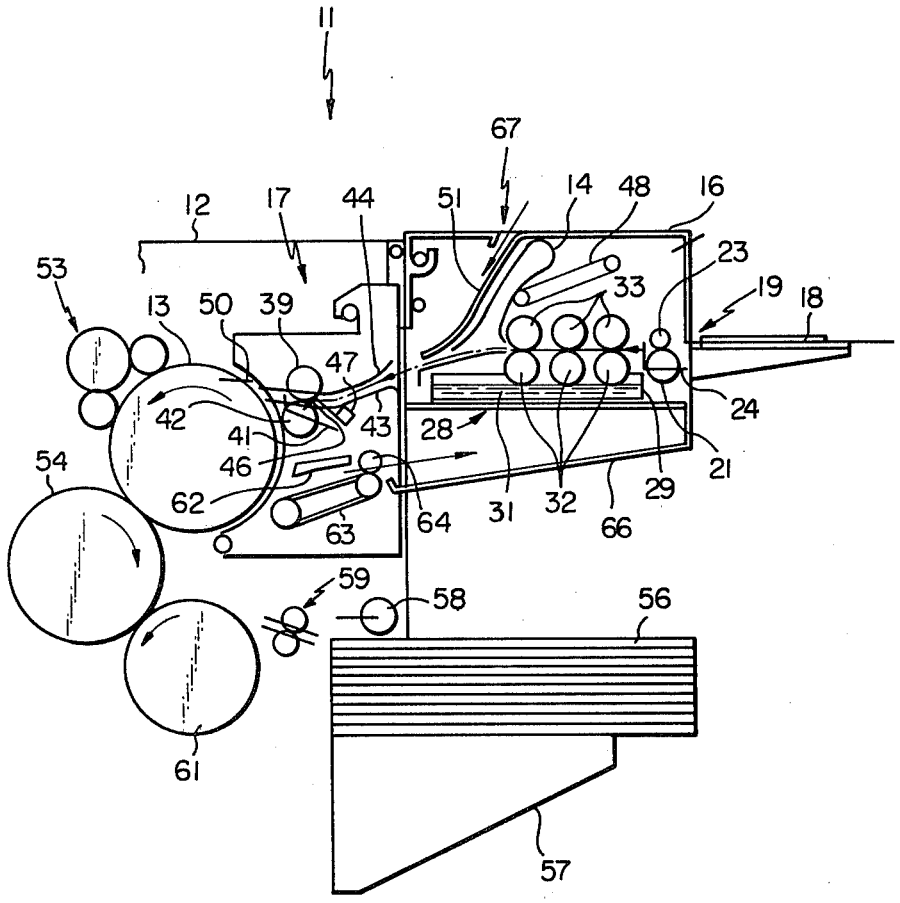
FIG. 1 is a schematic side view of a lithographic apparatus embodying the present invention.

Referring now to FIG. 1 of the drawing, a lithographic apparatus embodying the present invention is generally designated by the reference numeral 11 and comprises a main housing 12. A master drum 13 for windingly supporting a master sheet 14 for offset printing is rotatably disposed in the housing 12. The apparatus 11 further comprises an etching unit 16 mounted to the right side of the housing 12 and a feed unit 17 disposed inside the housing 12 between the etching unit 16 and the drum 13.

The master sheet 14 to be used for offset printing is slid over a support 18 into an inlet 19 of the etching unit 16. As best viewed in FIG. 3, the etching unit 16 comprises a lower feed roller 21 which is rotated counterclockwise at constant speed. An upper guide plate 22 is provided above the roller 21. A steel ball 23 is rotatably retained in a hole (not visible) formed through the guide plate 22 and urged by gravity toward engagement with the roller 21.

An L-shaped stopper 24 and an L-shaped actuator arm 26 are connected together for integral rocking movement about a pivot shaft 27. A spring (not shown) inside a solenoid 27 normally biases the actuator arm 26 and stopper 24 to a clockwise position shown in solid line in which the stopper 24 is disposed in the path of the master sheet 14. In this position, the leading edge (left edge) of the master sheet 14 will abut against the stopper 24 and be held thereby. Since the ball 23 is rather light, the roller 21 is able to slip over the lower surface of the sheet 14 without damage thereto.

When it is desired to feed the master sheet 14 to the drum 13 for offset printing, the apparatus operator presses a feed start switch (not shown) which energizes the solenoid 27. This causes the arm 26 and stopper 24 to pivot counterclockwise to phantom line positions thereof in which the stopper 24 is moved out of the path of the master sheet 14. Thus, the master sheet 14 is fed by the roller 21 toward an etching assembly 28.

The etching assembly 28 comprises a tank 29 for holding an etching liquid 31 and three lower etching rollers which are all designated as 32 and are partially immersed in the liquid 31. Whereas the rollers 32 are rotated counterclockwise by a suitable drive means (not shown), upper etching rollers 33 disposed closely above the rollers 32 are rotated clockwise at the same speed as the rollers 32. The master sheet 14 is fed leftwardly by the rollers 32 and 33 which apply the etching liquid 31 thereto to etch the master sheet 14 for printing.

The feed unit 17 comprises a rocker arm assembly 34 which is rockable about a shaft 36. A cam follower 37 attached to the assembly 34 engages the surface of a cam 38 which is integrally mounted to the master drum 13. During the time the master sheet 14 is being fed to the feed unit 17, the drum 13 and cam 38 are rotated to and maintained in a position in which a large radius portion **38*a* of the cam 38 engages the cam follower 37 and rotates the assembly 34** to a phantom line position.

The assembly 34 rotatably supports an idler roller 39. In addition, an L-shaped stopper 41 is fixed to the assembly 34 for integral movement. A feed roller 42 is rotated below the idler roller 39 counterclockwise at the same surface speed as the drum 13.

The feed unit 17 further comprises a lower support plate 43 over which the master sheet 14 is fed to the rollers 39 and 42. An upper guide plate 44 is provided above the plate 43. An actuator 46 of a microswitch 47 protrudes upwardly through an opening (not shown) formed through the plate 43.

With the assembly 34 in the clockwise phantom line position, the idler roller 39 is spaced upwardly from the feed roller 42 and the stopper 41 protrudes upwardly through an opening (not shown) formed through the plate 43. It will be noted that suitable openings are formed through the plates 43 and 44 for the rollers 39 and 41 respectively, although not illustrated.

As the master sheet 14 is fed from the etching unit 16 to the rollers 39 and 42 the leading edge of the master sheet 14 engages the actuator 46 and changes over the microswitch 47. Upon subsequent movement of the sheet 14 the leading edge thereof abuts against the stopper 41 and is thereby prevented from further movement.

Figure 3:
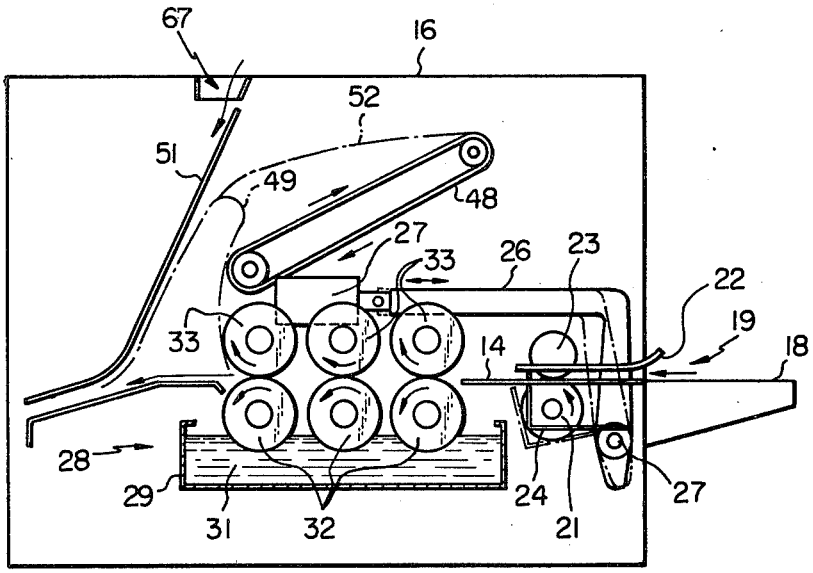
FIG. 3 is an enlarged schematic side view of an etching unit of the present apparatus.

However, the trailing edge portion (right portion) is still being fed leftwardly by the etching unit 16. As best seen in FIG. 3, the feed unit 17 further comprises an inclined conveyor belt 48 which is rotated clockwise. With the leading edge (left edge) of the master sheet 14 blocked by the stopper 41, the intermediate and trailing (right) edge portions of the sheet 14 are buckled or lifted upwardly as indicated in phantom line at 49. This action is ensured by the configuration of a guide plate 51 which is inclined upwardly as illustrated and the conveyor belt 48 which moves or lifts the trailing edge portion of the sheet 14 upwardly and rightwardly. Finally, the sheet 14 assumes a position indicated in phantom line at 52 in which the trailing edge of the sheet 14 is supported by the conveyor belt 48. It will be noted that the distance between the stopper 41 and the etching unit 16 is made conveniently shorter than the length (left to right dimension) of the master sheet 14 so that the conveyor belt 48 is disposed above the etching assembly 28 of the etching unit 16.

At a predetermined length of time after changeover of the microswitch 47, a control unit energizes a motor (not shown) to rotate the master drum 13 counterclockwise. This movement of the drum 13 and cam 38 causes the cam follower 37 to move off the large radius portion **38*a* of the cam 38 and the assembly 34 to rock counterclockwise to a solid line position thereof. This causes the stopper 41 to move out of the path of the master sheet 14 and also causes the idler roller 39 to pressingly engage the sheet 14 and feed roller 42. Preferably, movement of the conveyor belt 48 is either stopped or reversed to facilitate feeding of the sheet 14** in the leftward direction.

The master sheet 14 is fed leftwardly by the rollers 39 and 42 and preferably also the conveyor belt 48 into the bite of a clamp 50 which automatically closes after the leading edge of the master sheet 14 has entered thereinto. Further movement of the master drum 13 causes the master sheet 14 to be wound therearound for printing. It will be noted that since the initial position of the drum 13 and the leading edge of the master sheet 14 (in abutment with the stopper 41) are predetermined with precision prior to movement of the drum 13 and sheet feeding of the sheet 14 thereto, the leading edge of the sheet 14 will enter the clamp 50 and be gripped thereby in a precise and reliable manner. This positively prevents jams arising from a failure of the clamp 50 to grip the leading edge portion of the sheet 14.

Further illustrated is an inking unit 53 which applies ink to the master sheet 14. The ink image is transferred to a transfer roller 54. Paper sheets 56 are provided in a stack on a support 57 and fed one by one by feed rollers 58 and 59 between the transfer roller 54 and a pressure roller 61 so that the ink image is transferred to the sheets 56. After printing, the sheets 56 are discharged from the apparatus 11 by means which are not shown.

After the desired number of copies of the master sheet 14 have been made, the clamp 50 is released and the master sheet 14 stripped off the drum 13 by a separator pawl 62. The master sheet 14 is thereafter carried by a conveyor belt 63 and an idler roller 64 and discharged into a tray 66.

It will be noted that the upper surface of the guide plate 51 leads between the plates 43 and 44. This allows a master sheet manually inserted into an inlet 67 to be guided over the guide plate 51 to the feed rollers 39 and 42 for movement into engagement with the drum 13. In this case, the transfer sheet is initially stopped by the stopper 41. Then, a manual switch (not shown) is pressed to begin movement of the drum 13, retract the stopper 41 and engage the roller 39 with the sheet. Such a master sheet which does not require etching may be constituted by a previously used master sheet or a cleaner sheet used to clean the inking unit 53.

Figure 2:
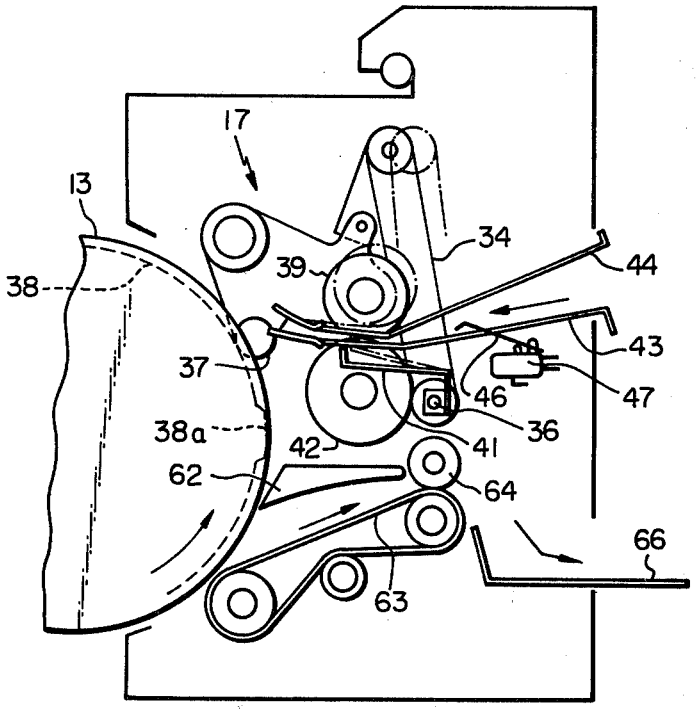
FIG. 2 is an enlarged schematic side view of a feed unit of the present apparatus.
Figure 4:
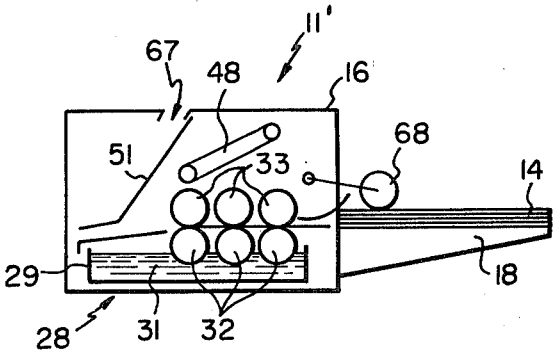
FIG. 4 is a simplified schematic side view of a modified form of the etching unit.
Figure 5:
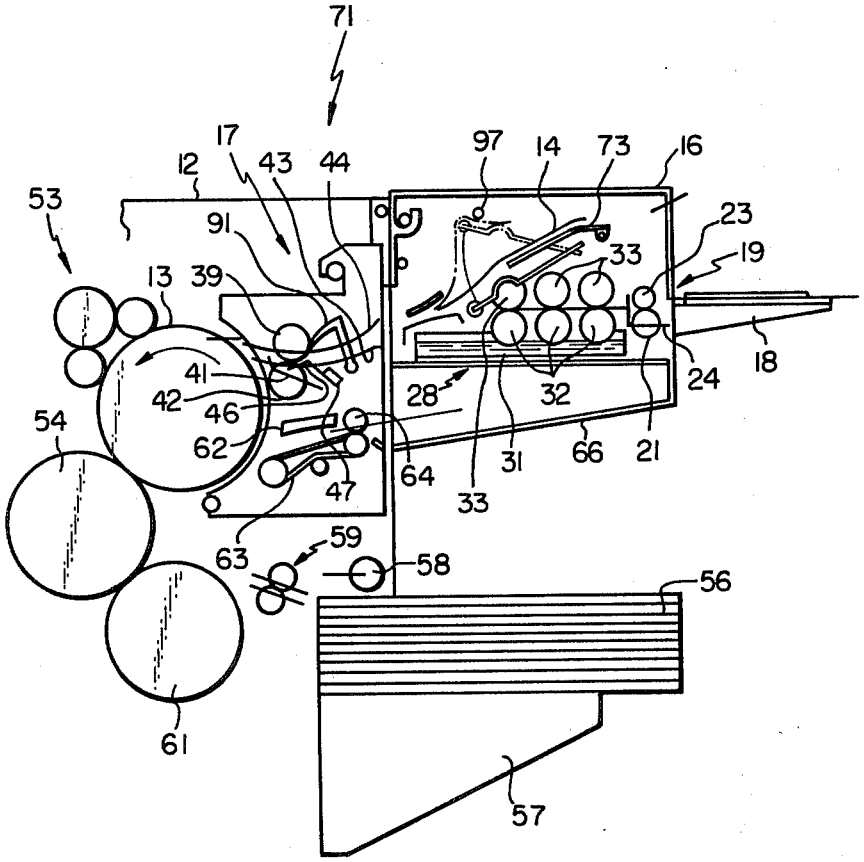
FIG. 5 is a schematic side view of another lithographic apparatus embodying the present invention.
Figure 6:
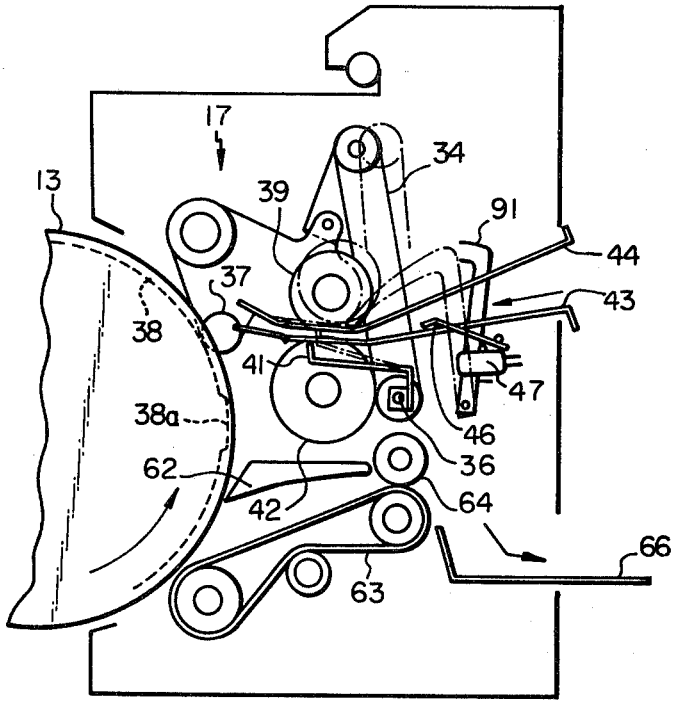
FIG. 6 is an enlarged schematic side view of a feed unit of the apparatus of FIG. 5.
Figure 7:
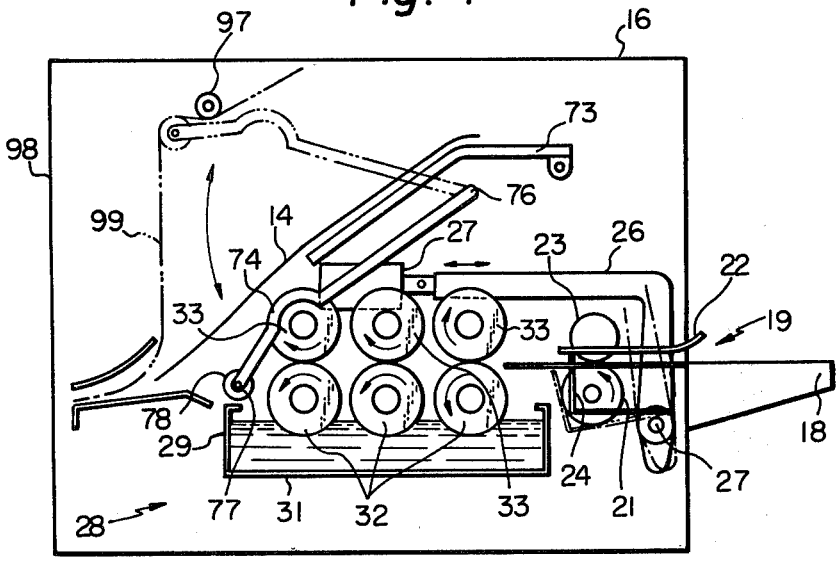
FIG. 7 is an enlarged schematic side view of an etching unit of the apparatus of FIG. 5.
Figure 8:
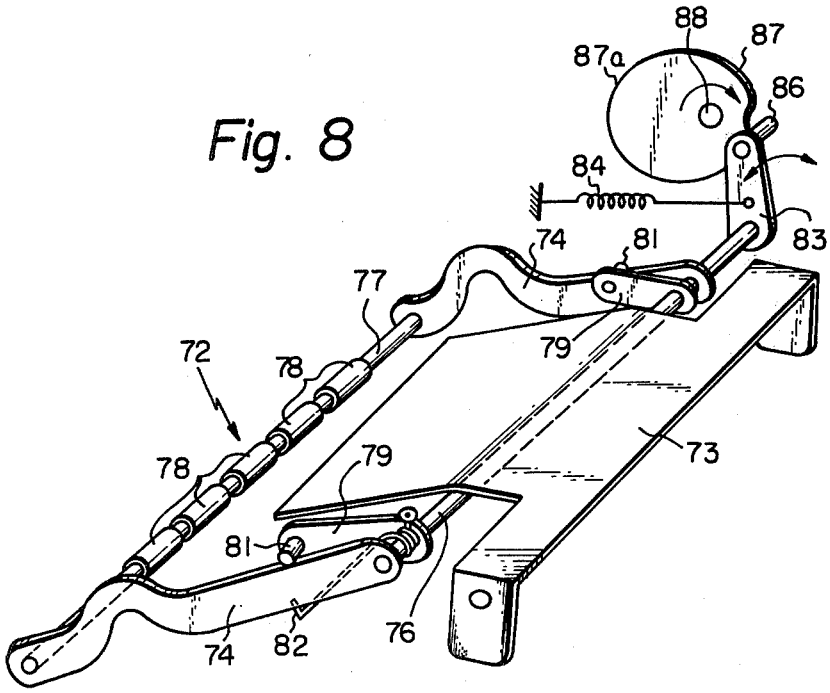
FIG. 8 is a perspective view of a lifting and actuator means of the apparatus of FIG. 5.

FIG. 4 illustrates a modified apparatus which is designated as 11' in which like elements are designated by the same reference numerals used in FIGS. 1 to 3. In the apparatus 11', the feed roller 21 and stopper 24 are replaced by a feed roller 68 which is rotated in an on-off manner to feed master sheets into the etching unit 16 one by one.

FIGS. 5 to 9 illustrate another lithographic apparatus 71 in which like elements are again designated by the same reference numerals. The general operation of the apparatus 71 is quite similar to that of the apparatus 11, and only those aspects which are different will be described below.

In the apparatus 71 a lifting means constituted by the conveyor belt 48 in the apparatus 11 is replaced by a rocker frame 72. Whereas the conveyor belt 48 in the apparatus 11 bifunctions as a support member for the trailing edge portion of the master sheet 14, a separate support plate 73 is provided in the apparatus 71 above the etching assembly 28.

The rocker frame 72 comprises two arms 74 which are rotatably supported about a shaft 76. The arms 74 are spanned at their ends by a lifter rod 77. A plurality of lifter rollers 78 are mounted on the rod 77.

Short arms 79 are rigidly fixed to the shaft 76. Pins 81 rigidly extend axially outwardly from the arms 79. Torsion springs 82 disposed between the arms 74 and 79 urge the arms 74 clockwise into abutting engagement with the pins 81. In this manner, the arms 74 are maintained in yieldable engagement with the arms 79 for unitary rocking movement.

An arm 83 is rigidly fixed to the shaft 76 and urged counterclockwise by a tension spring 84 so that a cam follower 86 mounted at the end of the arm 83 is maintained in engagement with the surface of a cam 87. The cam 87 is fixed to a rotary shaft 88.

Figure 9:
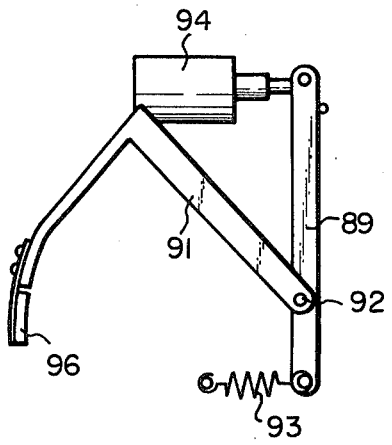
FIG. 9 is a side elevation of a clamp means of the apparatus of FIG. 5.

Best illustrated in FIG. 9 are a sickle-shaped rocker arm 91 and a straight rocker arm 89 which are fixed together for unitary rocking movement about a shaft 92. A tension spring 93 urges the arms 89 and 91 to a normal clockwise solid line position shown in FIG. 6. A solenoid 94 may be energized to rotate the arms 89 and 91 to a counterclockwise phantom line position. Preferably, a resilient engaging member or bar 96 is provided at the end of the arm 91.

In operation, the master sheet 14 is fed into abuting engagement with the stopper 41 by the etching unit 16 in the same manner described above. Prior to abutment of the leading edge of the master sheet 14 with the stopper 41 the rocker frame 72 is maintained in a lower solid line position and the arm 91 is maintained in the clockwise solid line position disengaged from the sheet 14. After a predetermined length of time has elapsed after the microswitch 47, which serves as a sensor, is changed over by the sheet 14, the solenoid 94 is energized to rock the arm 91 counterclockwise to the phantom line position in which the bar 96 clamps the leading edge portion of the master sheet 14 to the plate 43. This positively prevents the leading edge portion of the sheet 14 from slipping rightwardly as the trailing edge portion of the sheet 14 lifted by the rocker frame 72. It will be noted that the arm 91 may be provided to the apparatus 11.

Then, a motor (not shown) is energized to rotate the shaft 88 clockwise by one revolution. This causes the cam follower 86 to engage a large radius portion 87*a* of the cam 87 which causes the arm 83 and rocker frame 72 to rock clockwise against the force of the spring 84. One revolution of the cam 87 causes the rocker frame 72 to rock from the lower solid line position to the upper phantom line position and then back down to the lower solid line position. During this movement, the lifter rod 77 lifts the trailing edge portion of the sheet 14 onto the support plate 73 to the position illustrated in solid line. A shaft 97 is provided to prevent the trailing edge portion of the sheet 14 from flopping against a left wall 98 of the etching unit 16 as indicated at 99.

After the master sheet 14 has been lifted onto the support plate 73 and the rocker frame 72 returned to the lower position thereof, the solenoid 94 is de-energized and the arm 91 rotated clockwise away from the master sheet 14 to unclamp the same. Then, the sheet 14 is fed to the drum 13 in the manner described above.

Figure 10:
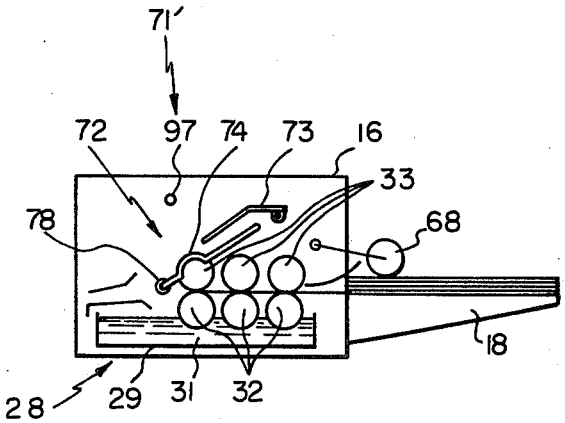
FIG. 10 is a simplified schematic side view of etching unit of the apparatus of FIG. 5.

FIG. 10 illustrates a modified form of the apparatus 71, designated as 71′, in which the roller 21 is replaced by the roller 68.

In summary, it will be seen that the present invention provides a lithographic apparatus in which a master drum and an etching unit are operated at different speeds but a master sheet is fed from the etching unit to the master drum without the provision a large and complicated conveyor belt or speed control mechanism. Various modifications will become possible for those skilled in the art after receiving the teachings of the present disclosure without departing from the scope thereof, especially regarding the particular configuration of the lifting means for lifting the trailing edge of the master sheet onto the support member.

What is claimed is:

1. A lithographic apparatus including a master drum for holding a master sheet and etching means for etching the master sheet and having means for feeding the master sheet therethrough, characterized by comprising:

feed means disposed between the etching means and the master drum for feeding the master sheet from the etching means into engagement with the master drum, a distance from the etching means to the feed means being smaller than a length of the master sheet, the feed means including retractable stop means against which a leading edge of the master sheet is stoppingly abutable, support means disposed above the etching means for supporting a trailing edge portion of the master sheet and lifting means for lifting the trailing edge portion of the master sheet onto the support means.

2. An apparatus as in claim 1, in which the support means and lifting means are integral and comprise an inclined conveyor means.

3. An apparatus as in claim 1, further comprising guide means leading to the stop means for guiding a manually inserted master sheet to the stop means.

4. An apparatus as in claim 1, further comprising sensor means for sensing abutment of the leading edge of the master sheet against the stop means and producing a signal in response thereto, the lifting means comprising a lifting member movable between a normal lower position and an upper position and actuator means for moving the lifting member from the lower position to the upper position and then back to the lower position in response to the signal.

5. An apparatus as in claim 4, in which the lifting member comprises a rocker frame, the actuator means comprising cam means for rocking the rocker frame.

6. An apparatus as in claim 1, in which the feed means further comprises clamp means for clampingly holding a leading edge portion of the master sheet after abutment of the leading edge of the master sheet against the stop means.

7. An apparatus as in claim 6, in which the clamp means comprises a support member over which master sheet is supportingly moved and a clamp member for clamping the leading edge portion of the master sheet to the support member.

8. An apparatus as in claim 6, further comprising sensor means for sensing abutment of the leading edge of the master sheet against the stop means and actuating the clamp means to clamp the leading edge portion of the master sheet in response thereto.

9. An apparatus as in claim 7, in which the clamp member comprises a rocker arm.

* * * * *